United States Patent [19]

Sondergeld

[11] Patent Number: 4,861,106

[45] Date of Patent: Aug. 29, 1989

[54] SEAT FOR AN OFFICE CHAIR OR THE LIKE, WITH SEAT AND BACK ADJUSTABLE, ESPECIALLY BY BODY WEIGHT DISPLACEMENT

[76] Inventor: Horst Sondergeld, Schongauer Weg 47, D-7800 Freiburg, Fed. Rep. of Germany

[21] Appl. No.: 209,544

[22] Filed: Jun. 21, 1988

[30] Foreign Application Priority Data

Jun. 24, 1987 [DE] Fed. Rep. of Germany ..... 3720849
Jan. 13, 1988 [DE] Fed. Rep. of Germany ..... 3800754

[51] Int. Cl.[4] ..... A47D 13/10; A47C 1/02

[52] U.S. Cl. ..... 297/316; 297/273; 297/280

[58] Field of Search ..... 297/273, 276, 280, 316, 297/317, 320, 68, 83, 84, 85, 86, 87

[56] References Cited

U.S. PATENT DOCUMENTS

| | | | |
|---|---|---|---|
| 257,873 | 5/1882 | Klein | 297/280 |
| 303,551 | 8/1884 | Arnold | 297/68 |
| 465,275 | 12/1891 | Kennedy et al. | 297/83 |
| 561,908 | 6/1896 | Munson | 297/280 |
| 648,740 | 5/1900 | Haggard et al. | 297/273 X |
| 898,305 | 9/1908 | Barnhart | 297/83 |
| 2,470,364 | 6/1947 | Niederhauser | 297/316 |
| 2,567,222 | 9/1951 | Lorenz | 297/87 |
| 4,533,177 | 8/1985 | Latone | 297/301 |

FOREIGN PATENT DOCUMENTS

| | | |
|---|---|---|
| 3415555 | 2/1985 | Fed. Rep. of Germany . |
| 3433374 | 5/1986 | Fed. Rep. of Germany . |
| 3632131 | 3/1988 | Fed. Rep. of Germany . |

*Primary Examiner*—James T. McCall

[57] ABSTRACT

The invention relates to a seat assembly for an office chair or the like, having a seat and back (6, 7) which are adjustable especially by shifting the body and having a cradle (5). The seat and the back are hinged together at their adjoining ends by at least a first articulation (8) and have, at points distanced from the articulation (8), bearing elements (13, 14) which are suspended or guided on the cradle by positive guiding means (10, 11) and are mounted for movement along paths established by the positive guiding means. The articulation (8) is free-floating. The bearing elements (13, 14) are guided by the positive guides (10, 11) independently of one another.

14 Claims, 13 Drawing Sheets

SEAT FOR AN OFFICE CHAIR OR THE LIKE, WITH SEAT AND BACK ADJUSTABLE, ESPECIALLY BY BODY WEIGHT DISPLACEMENT

The invention relates to a seat assembly of the kind defined in the introductory part of claim 1.

Seat assemblies having seats and/or backs adjustable especially by body weight displacement are already known in a number of forms (DE-AS Nos. 12 85 701 and 20 26 929, DE-PS Nos. 854421, 2931072 and 3313677, WO Nos. 83/03957 and 85/04084, U.S. Pat. No. 4,504,090), and are used mainly for chairs in offices, motor vehicle seats, or the like.

Usually a pressure is transferred to the seats and backs of such chairs through linkages or cam systems such that the backs are pressed with a certainforce against the user's back. Advantages of such apparatus over systems with automatic return of the backs by spring force are to be seen in the fact that the force ratios automatically adapt to the different body weights, so that adjustment of the return force is not necessary, and the return force increases in proportion to the changes in the angle of the backs. Persons of different weight are therefore securely supported in any angular position of the seat back.

The known system with automatic return of the back are provided with positive controls between the seat and the back, which permit only an established pattern of movement. A customized pattern of movement therefore is not possible in these systems.

It is the object of the invention to configure the chair of the kind described in the beginning with simple means in such a manner that the angle of inclination of the seat and back can be freely selected within a wide range, both individually and relative to one another, by shifting the user's body weight.

The distinctive features of claim 1 serve for the attainment of this object.

The invention brings with it the advantage that the angles of inclination of the seat and back are largely freely selectable absolutely and relative to one another, and in addition, with the seat in a preselected position relative to the back, the chair can be rocked back and forth also so a whole between two end positions in a virtually continuous manner. Furthermore, between a bolt-upright relative position and a recumbent position, a great number of intermediate positions are produced, so that the user is offered great freedom of movement and selection.

Additional advantageous features of the invention will be found in the subordinate claims.

The invention will be further explained below by examples of its embodiment, in conjunction with the appended drawing, wherein:

FIG. 1 is a roughly, simplified, diagrammatic side view of a first embodiment of the chair according to the invention, FIG. 2 shows diagrammatically a number of possible seating positions of the chair of FIG. 1, FIG. 3 is a diagrammatic front elevation of a second embodiment of the chair with a locking device different from the one in FIG. 1, FIG. 4 shows details of the tilting mechanism of the chair according to FIG. 3, FIG. 5 shows details of the tilting mechanism according to FIG. 4, represented in the open state, FIGS. 6 and 7 are views corresponding to FIGS. 1 and 3 of a third embodiment of the invention, FIG. 8 is a diagrammatic representation of a fourth embodiment of the invention in an enlarged cross section along line VIII—VIII of FIG. 7, FIGS. 9 and 10 ar sections along lines IX—IX and X—X of FIG. 8.

Figure 2:
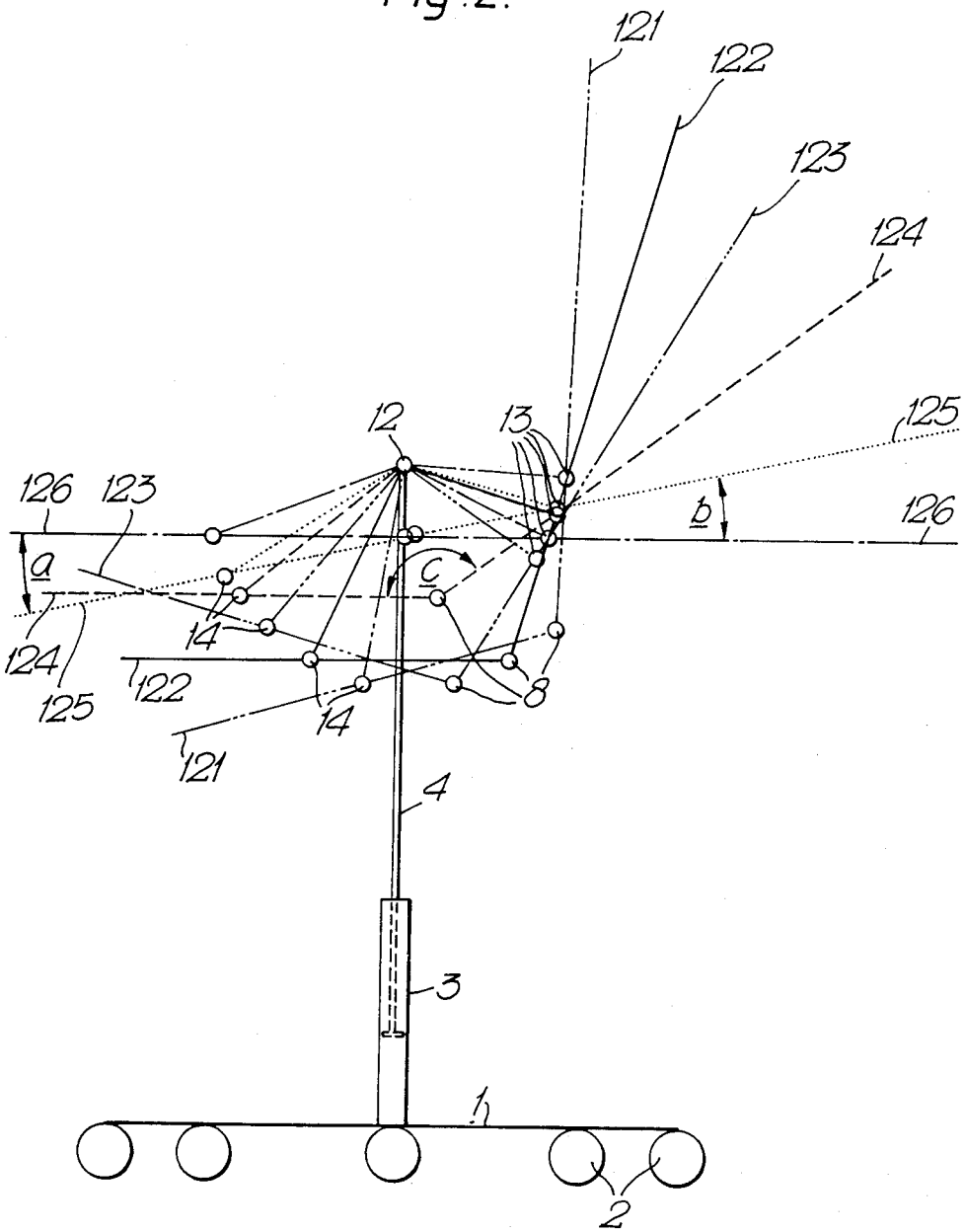
Figure 16:
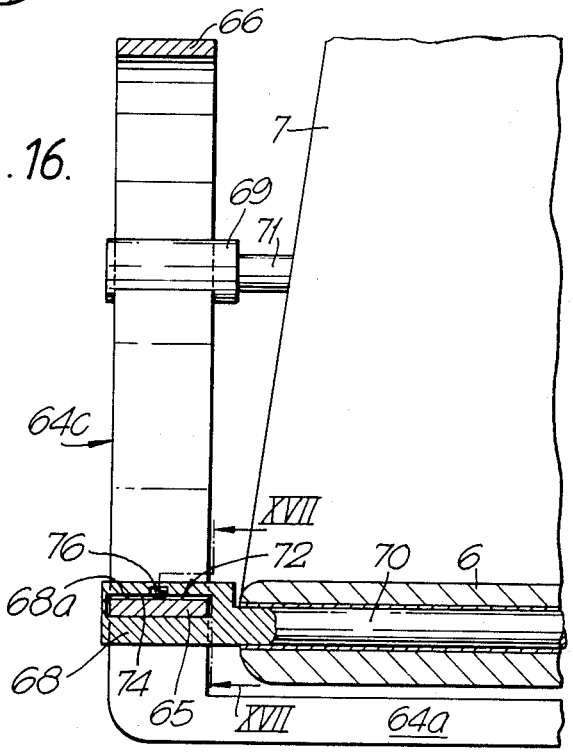
Figure 17:
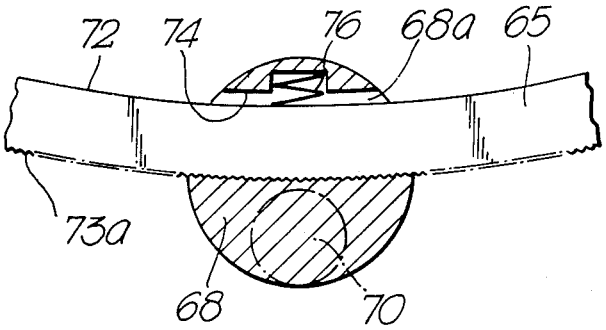
Figure 18:
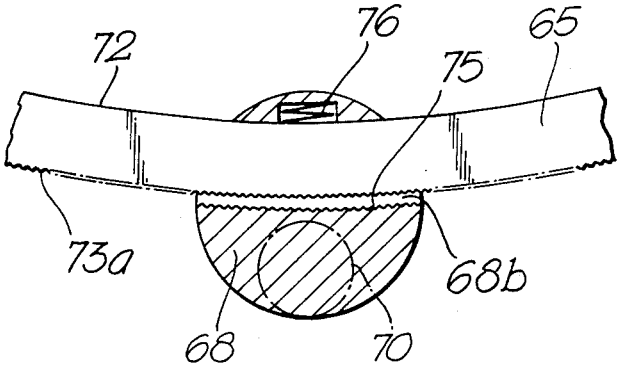
Figure 22:
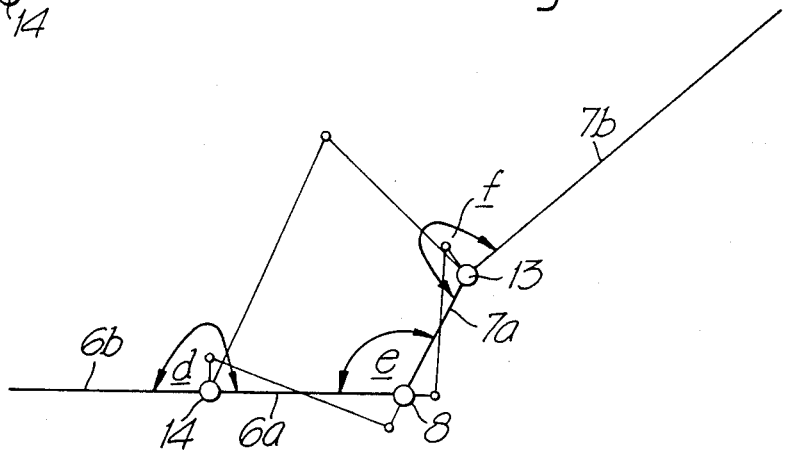
Figure 23:
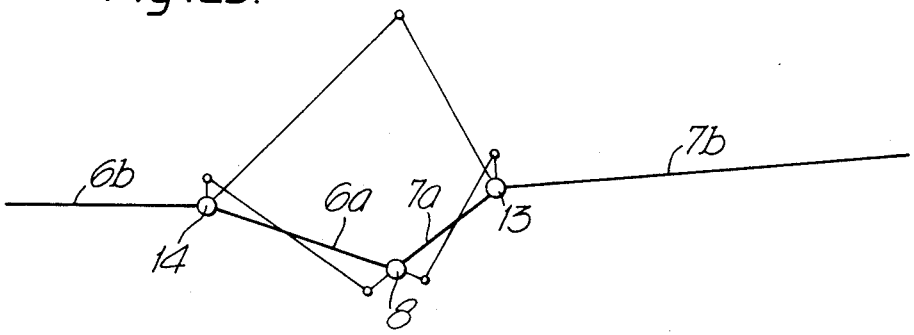
Figure 24:
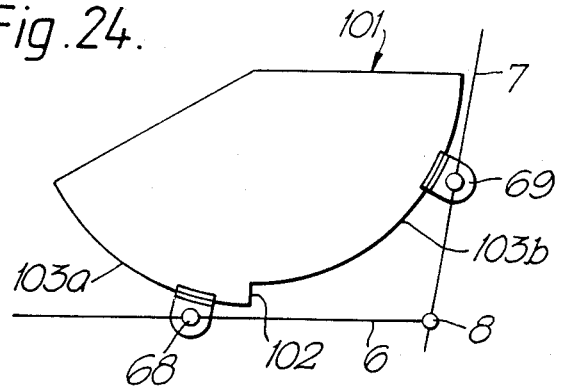
Figure 25:
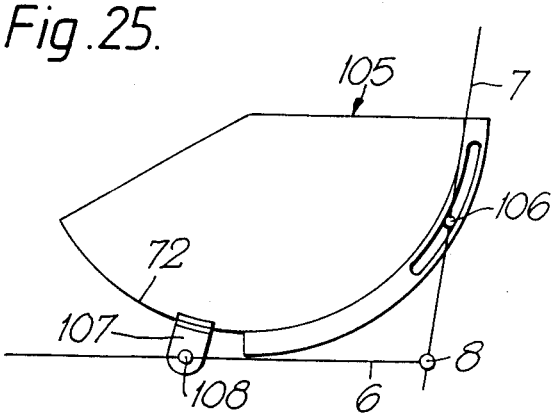
Figure 26:
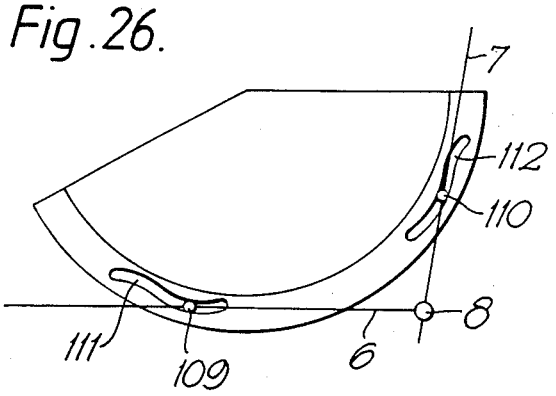

FIGS. 17 and 18 are sections along lines XVII—XVII and XVIII—XVIII in FIG. 16, in the locked and unlocked state, respectively, and on a larger scale, FIGS. 19 to 23 are diagrammatic views, partially corresponding to FIG. 2, of different sitting and recumbent position, as well as parts of a sixth embodiment of the invention, and FIGS. 24 to 26 are diagrammatic views corresponding substantially to FIGS. 8 to 16, of possible modifications of the embodiments shown in FIGS. 6 to 18.

Figure 1:
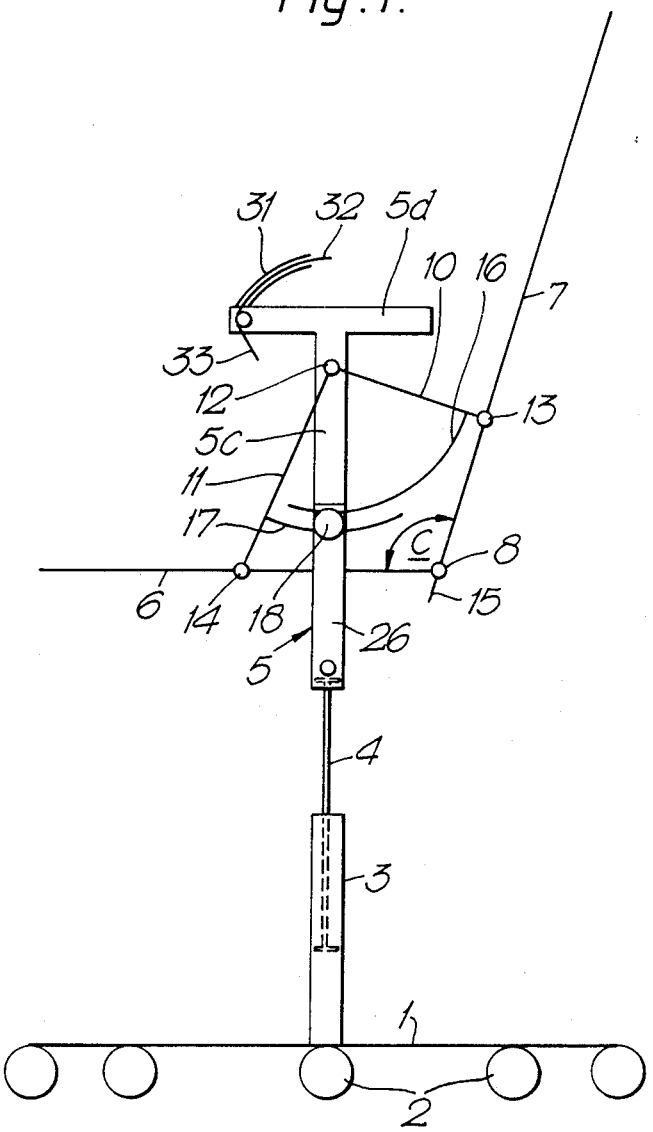
Figure 3:
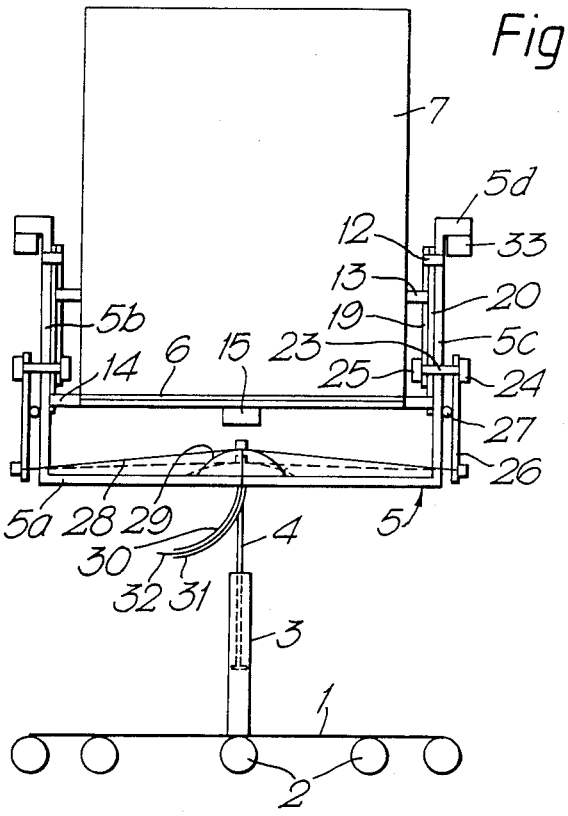

According to FIGS. 1 to 3, the base of an office chair is a frame 1 with, for example, five legs in a star configuration, on the ends of which casters or wheels 2 are rotatably fastened. From the center of the frame 1 a tube 3 extends vertically upward, in which a shank 4 of a U-shaped cradle 5 is mounted for rotation and adjustment in height. The cradle 5 has a crossbar **5*a* disposed preferably perpendicular to the shank 4, and two limbs fastened to it ends and preferably disposed parallel to the shank 4, which form cradle arms 5*b* and 5*c*, on whose free ends diagrammatically represented arm rests 5*d* can be affixed. The crossbar 5*a*, the cradle arms 5*b* and 5*c*, and the arm rests 5*d*** are preferably joined together fixedly in a single assembly or are made in one piece.

The seat according to the invention is suspended on the cradle 5. The seat consists of a seat 6 and a back 7 which are articulated together at their back and bottom ends, respectively, preferably on both sides, by at least a first articulation 8 which is free-floating and has its shaft extending through the back 7, while the ends of the shaft extend into the seat 6. The width of the chair is slightly smaller than the distance between the two cradle arms **5*a* and 5*b***.

The seat 6 and back 7 have bearing elements at points spaced away from the axis of rotation of articulation 8, which are hung movably from the cradle 5 on positive guiding means.

The positive guiding means consist, according to FIG. 1, for example, of two links 10 and 11. The link 10 is joined at one end by a second articulation 12 to the cradle arm **5*b* and 5*c*, respectively, and at the other end by a support element in the form of a third articulation 13 to the back 7, the axis of articulation 13 being situated above the axis of rotation of articulation 8 (FIG. 1). The link 11 is joined at one end by the second articulation 12, or an additional articulation, but one having the same axis of rotation, to the cradle arm 5*b* and 5*c*, respectively, and at the other end by a support element in the form of a fourth articulation 14 to the seat 6, the axis of rotation of articulation 14 being disposed, according to FIG. 1, between the axis of rotation of articulation 8 and the free front end of the seat 6. Preferably, identical articulations 12, 13 and 14 and links 10 and 11 are provided on each side of the chair. At the same time the second articulations 12 are mounted each on its associated cradle arm 5b and 5c, respectively, in a stationary, i.e., undisplaceable manner, so that a quadrilateral linkage consisting each of the articulations 8, 12, 13 and 14 is formed on each side of the chair, the articulationn 12 representing a center of rotation fixed in space, about which the movable parts of the seat mechanism can move in many different ways. Since the quadrilateral linkages can be made in a mirror-image relationship on both sides of the chair, only the one represented in FIG. 1**, and its operation, will be described.

In this embodiment the articulation 8 is at a distance of 200 mm from the surface of the still-unpadded seat 6 when the latter is disposed horizontally, and when the back 7 is vertical. The distance between the axes of rotation of the articulations 12 and 13 amount to about 170 mm, the distances between the axes of rotation of the articulations 12 and 14 to about 190 mm, the distances between the axes of rotation of articulations 8 and 14 to about 170 mm, and the distances between the axes of rotation of articulations 8 and 13 to about 150 mm. All these distances have proven desirable from the ergonomic point of view, but can also be varied within certain limits.

To prevent the back 7 from going back too far in the extreme recumbent position, the latter has an abutment 15 which cooperates with the seat 6 and permits a maximum angle of 180° between the latter and the back.

The adjustments of the seat 6 and back 7 which are possible by means of the quadrilateral linkages are represented diagrammatically in FIG. 2 for a number of different sitting positions. These sitting positions are made possible by the fact that the axes of the articulations 13 and 14 can be moved each independently or together in combination along cylindrical surfaces whose axes coincide with the axis of rotation of the second articulation 12. The links 10 and 11 constitute positive guiding means which establish the radii of the curving movements of the articulations 13 and 14. On the other hand the articulation 8 is kept free floating, and for this reason the angle of inclination of either of the parts 6 or 7 is also kept constant and only the angle of inclination of the other part 6 or 7 can be varied. By locking the articulations 13 and 14 the backs and seats 7 and 6 can also be fixed in space.

To provide the links 10 and 11 also with lateral guidance and be able in a simple manner to lock up the different sitting positions according to FIG. 2, the links 10 and 11 are additionally guided on the cradle 5. In the embodiment according to FIG. 1, the links 10 and 11 are for this purpose rigidly affixed to locking arms 16 and 17, respectively, which are indicated diagrammatically in FIG. 1. The locking arm 16 is joined to the link 10, extends toward link 11, and is of a circular configuration. The locking arm 17 is joined to the link 11, extends toward link 10 and is of an arcuate configuration. In both cases the center of the arc lies on the axis of rotation of the second articulation 12. If the distance between the locking arms 16, 17, is relatively small, as it appears in FIG. 1, both can be locked or released to change the sitting position with a common clamping means 18, e.g., a clamping screw or the like, fastened to the cradle arms 5b and 5c, i.e., they form a locking means associated with the positive guiding means, since the distances between the various parts of the locking arms 16 and 17 and the clamping screw 18 do not change when any of the possible sitting positions is established. Alternatively, an individual clamping screw 18 could be associated with each locking arm 16 and 17.

Figure 5:
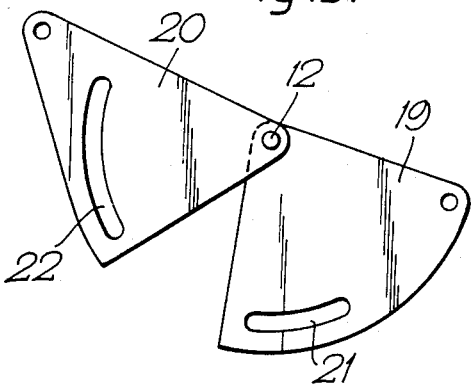
Figure 4:
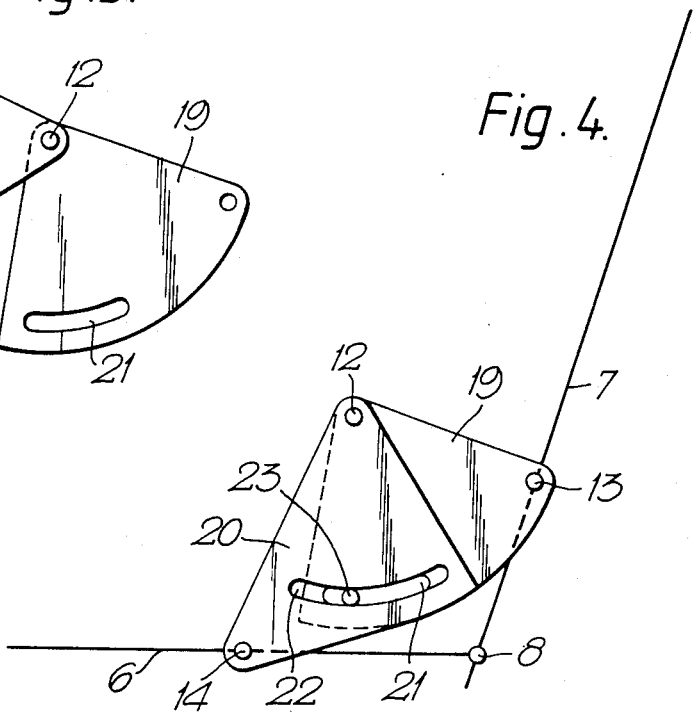
Figure 9:
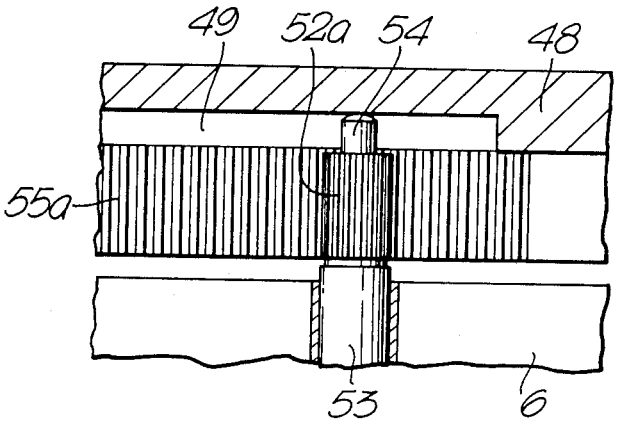

In the embodiment that is preferred for reasons for stability and ease of manufacture, which is represented in FIGS. 3, 4 and 5, the links 10 and 11 are portions of a plate 19 and 20, respectively. Each plate 19, 20, has an elongate hole in the form of an arcuate slot 21 and 22, respectively, the axis of rotation of the second articulation 12 running again through the centers of the arcs. Furthermore, the radii of the arcs of the slots 21 and 22 are identical. Both plates 19 and 20 are furthermore made so large that they lie against one another in all desired, producible sitting positions. The cradle arms 5b and 5c have, as seen in FIGS. 3 and 4, a guiding means extending through both slots 21 and 22, and consisting, for example, of a bolt 23 extending loosely or with a snug fit through the cradle arm 5c, so that the articulation 12, the bolt 23 and the plates 19 and 20 constitute positive guiding means for the support elements of the seat which are in the form of the articulations 13 and 14. The articulations 8 are again disposed for free floating.

The bolt 23 has a head 24 on the outside, which rests against the outside of a lever 26 engaging the cradle arm 5c. The plate 20 contacts the inside of the cradle arm 5c, and plate 19 contacts the inside of the latter, the bolt 23 passing also through the slots 21 and 22. On the free end of the bolt 23 there is fastened a locking means 25 which comes to lie between the inside of the plate 19 and the chair seat, and together with the plates 19 and 20 forms a means for locking up the positive guiding means. On the other cradle arm 5b there is provided another such arrangement. The locking means 25 is, for example, a nut which is driven onto a threaded section of the bolt 23, so that, when the nut is tightened, the plates 19 and 29 are clamped against one another and pressed against the cradle arm 5c, thus locking the seat in position by the clamping action of these parts. When the locking means 25 is released, the plates 19 and 20 can slip against one another and on the cradle arm 5c, which permits a change in the sitting position. A particular advantage of the plates 19 and 20 and of the slots 21 and 22 is that, by preselecting the length of the slots, the range of adjustment of the chair can be established, because in the extreme end sitting positions the bolt abuts against at least one end of the slots 21 and 22. The slot length therefore simultaneously establishes the extreme end positions of the seat 6 and back 7.

To easily product and lock up any desired sitting position by simple body weight displacement, it has been found desirable to make the friction between the plates 19 and 20 low and the friction between the cradle arms 5b, 5c, and the plates 19, 20, and between the latter and the locking means 25, great. This is achieved most simply by placing washers of suitably high or low coefficients of friction between the above parts.

To enable the sitting position desired in a particular case to be changed with a simple hand lever without turning the bolt 23 or the locking means 25, the locking device according to FIG. 3 has on both sides of the seat the two-armed lever 26, which is fulcrumed, for example, on the outside of the associated cradle arms 5b, 5c, and disposed parallel to the latter. A section of the bolt 23 situated between the head 24 and the cradle arm 5b, 5c, passes through the one lever arm. In a middle portion the lever 26 is fulcrumed by means of a roller 27 or the like. To its other lever arm there is fastened one end of a cable 28 which runs between the two cradle arms 5b, 5c, and the levers 26 (FIG. 3).

Centrally under the cable 28 and on the cross member 5a there is also disposed a spring 29 preferably in the form of a leaf spring, which keeps the cable 28, a wire cable for example, tensed with a given force. The upper lever arms of the levers 26, and with them the heads 24 of the bolts 23 are thereby biased outwardly, which results in a clamping together of the plates 19 and 20 against the cradle arms 5b, 5c, under the effect of the locking means 25. The locking means 25 can therefore be in the form also of spring rings, for example, or the like, in this embodiment. The sitting position is thus maintained by clamping. If it is desired to produce a different sitting position, the spring 29 is biased by means of an actuating mechanism 30 by pulling it down to the position indicated in broken lines in FIG. 3. This relieves the cable 28, and the spring force acting on the levers 26 is so greatly reduced that the clamping action between the plates 19, 20, and the cradle arms 5b, 5c, is largely eliminated. When the actuating mechanism 30 is released, the spring 29 returns to its largely relaxed position, so that the lock-up is again active. The actuating mechanism 30 contains, for example, a Bowden pull 31, whose pull wire 32 is fastened to the spring 29 (FIG. 3) at one end and to an operating lever 33 at the other, which is pivotingly mounted in an easy-to-reach position, for example on one of the arm rests 5d (FIG. 1). At the same time, by just a partial actuation of the operating lever 33 the clamping force can be proportioed such that a lesser or greater force is necessary in order to change the sitting position.

According to a third embodiment of the invention (FIGS. 6 and 7), wherein equal parts are provided with the same reference numbers as in FIGS. 1 to 5, the shank 4 is joined to a U-shaped cradle 34 which has a cross member 34a disposed preferably perpendicular to the shank 4, and two uprights in the form of preferably frame-like side members 34b and 34c, fastened to its extremities and best disposed parallel to the shank 4. The cross member 34a, the side members 34b and 34c, and the shank 4 being fixedly joined to one another to form one unit, or they are made in one piece. The side member 34c is of a half-ring configuration and has a lower, arcuate frame section 35 which extends, for example, over about a third of a circle. The one end of the frame member 35 is joined to the one end of a straight section 36 which is approximately perpendicular to the shank 4 and can be configured simultaneously as an arm rest, while the other end of the frame member 35 is joined by a straight section 37 to the other end of the straight section 36. The other side member 34b is of similar construction. The upper portion of the side members 34b and 34c, composed of the straight sections 36 and 37, can alternatively be of a free form or it can also be omitted.

Figure 6:
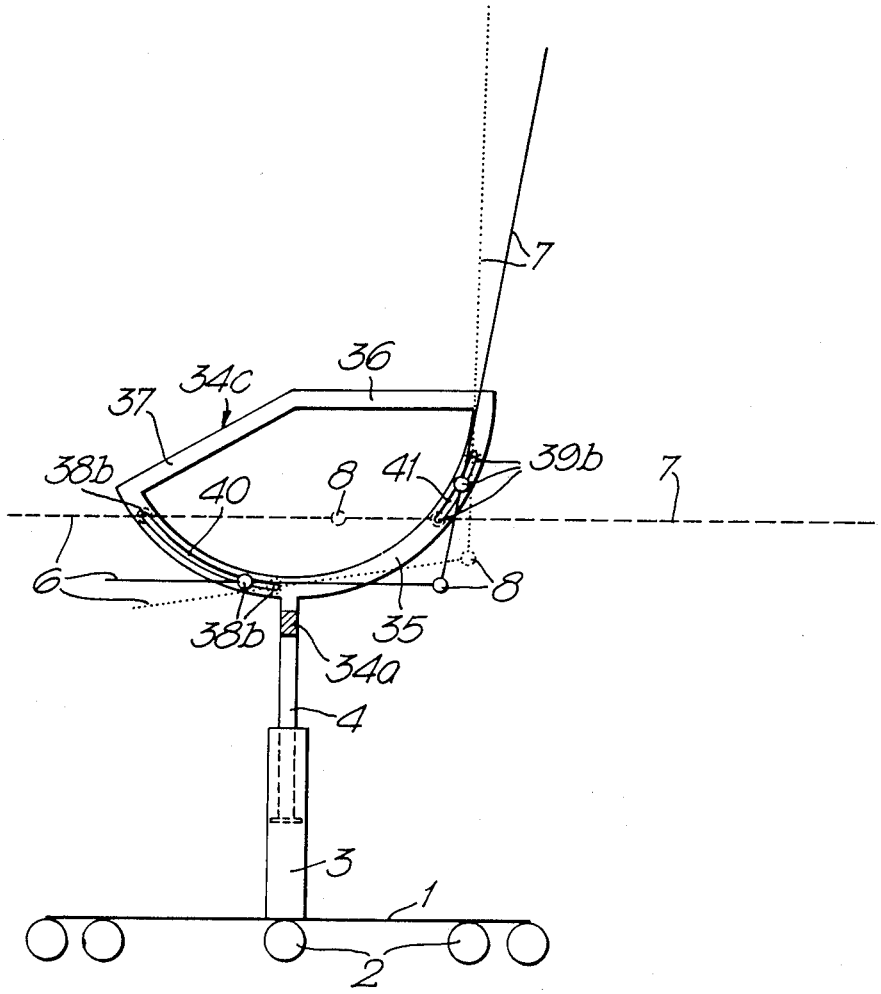

The chair configured in accordance with FIGS. 1 to 5 has at points spaced away from the articulations 8, bearing elements which consist, for example, of tenions 38a, b, provided on both sides of the seat 6, and tenons 39a, b, provided on both sides of the back 7, which consist, for example, of the ends of the shaft passing through the seat 6 and back 7, respectively, or of the rotatable shafts 38 and 39, respectively, which are disposed parallel to the axis of rotation of the articulation 8. The tenons 38a, b, extend each into arcuate slots 40 formed in forward sections of the arcuate frame members 35, while the tenons 39a, b, extend each into arcuate slots 41 which are formed in rearward sections of the frame member 35. The lower boundaries of the slots 40, 41, act as cams for the tenons 38a, b, and 39a, b, lying on them and carried by them, whose axes are disposed substantially parallel to the axis of rotation of the articulation 8. The articulation 8 is in turn free-floating, so that the tenons 38a, b, of the seat 6, when the back 7 is held, can be moved back and forth freely in the slots 40, or the tenons 39a, b, of the back 7 can be moved freely back and forth in the slots 41 when the seat 6 is held. Also possible is a combined movement both of the seat and of the back 6 and 7, respectively. The frame member 35, with its slots 40 and 41, thus constitutes a positive means for the guidance of the bearing elements of the seat and back in the form of tenons 38a, b, and 39a, b, respectively. The tenons 38a, b, and 39a, b, are furthermore best cylindrical and therefore rotatably mounted in the slots 40 and 41, so that they can also rotate when the seat or back is adjusted. Like FIG. 2, FIG. 6 shows three different positions which the seat 6 and back 7 can assume, in solid, dotted and broken lines. The length of the adjustment is determined in each case by the length of the slots 40 and 41.

Figure 7:
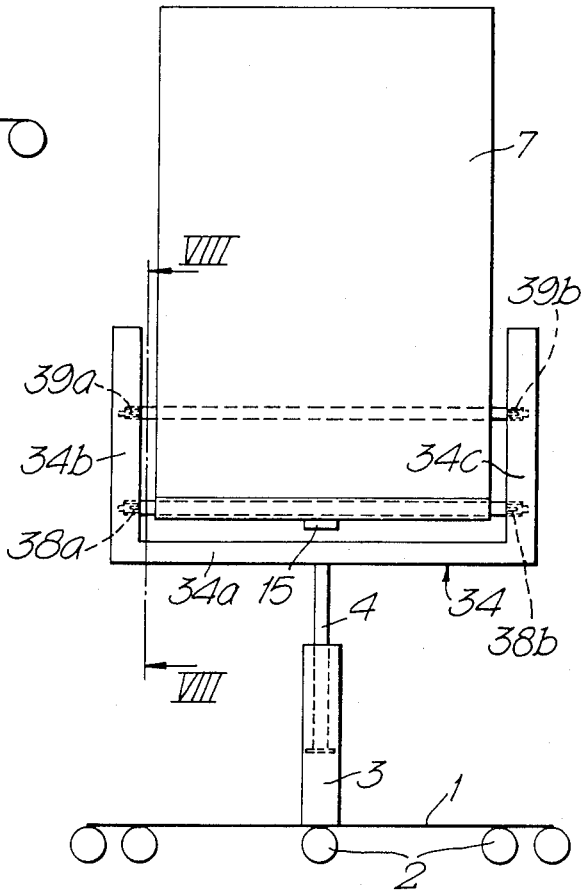

An embodiment of the invention that is similar to the embodiment illustrated in FIGS. 6 and 7 is represented in FIGS. 8 to 12 in conjunction with a locking system. The side members 34b, 34c, represented in FIGS. 6 and 7 are replaced, in an otherwise identical arrangement, by side members 44 which are of bipartite construction, each having an outer part 45 and an inner part 46. Both of the side members 44, and with them the outer and inner parts 45 or 46, are preferably in a half-ring form and otherwise of a mirror-image configuration. Each outer part 45 has an arcuate bottom part 47 and a guiding part 48 disposed perpendicular thereto, in which, at the places where the slots 40, 41, are arranged in FIGS. 6 and 7, similarly formed grooves 49a and 49b are situated.

The bearing elements represented as simple tenons 38a, b, and 39a, b, in FIGS. 6 and 7, are here configured as gears 52a, 52b, which are journaled on both sides of the seat and backs 6 and 7. The gears 52a, b, are in the form of external teeth at the ends of shafts 53 which are journaled in the seat and backs 6 and 7, and their extremities project laterally from the latter. The gears 52a, b, are adjoined outwardly by short, cylinderical guide pins 54. The length of the shaft 53 between the two side members 44 is such that the guide pins 54 will be situated in the grooves 49a, b. At the same time the bottom parts 47 have a corresponding guiding curve in the form of internally toothed racks 55a and 55b which are engaged by the gears 52a, b, and which are formed into arcs which correspond exactly to the arcs along which the grooves 49a, b, run. For the adjustment of the seat 6 and/or back 7, therefore, the gears 52a, b, can roll upon the corresponding internal racks 55a, b, while the shafts 53 simultaneously rotate in the seat 6 and back 7 and the guide pins 54 are guided in the grooves 49a, b, whose ends determine the limits of the possible range of adjustment. To reduce friction it is possible to make the depth of the grooves 49a, b, somewhat greater than corresponds to the diameter of the guide pins 54. The guide pins 54 and grooves 49a, b, furthermore prevent any accidental disassembly of the seat and back. The adjusting mechanisms for the seat 6 and the back 7 are of substantially identical construction.

Figure 8:
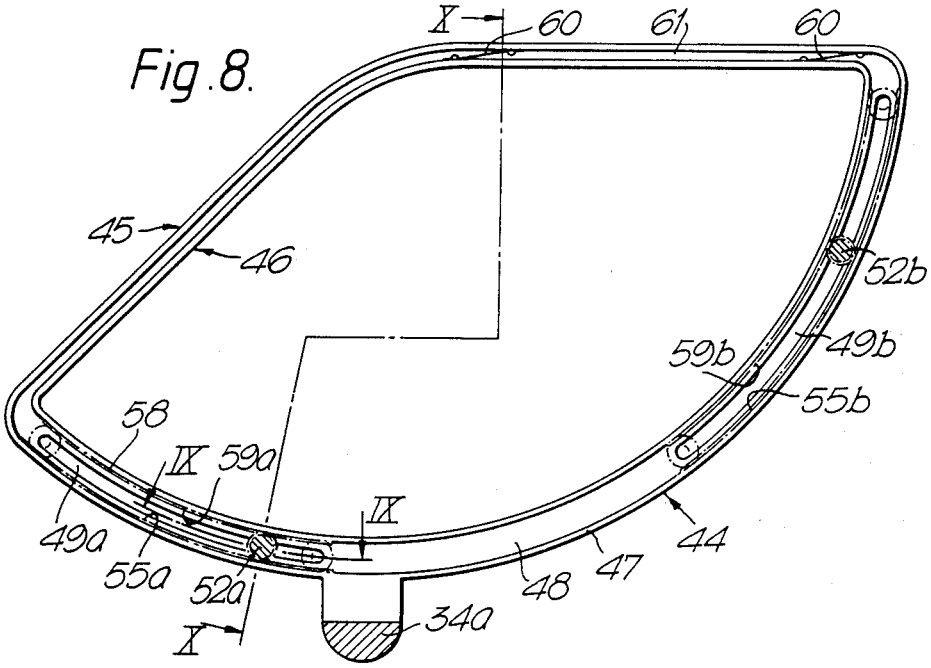
Figure 10:
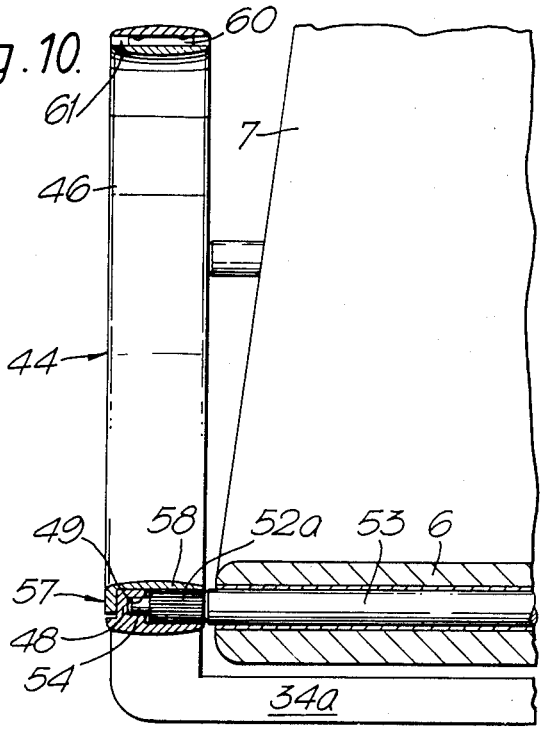
Figure 11:
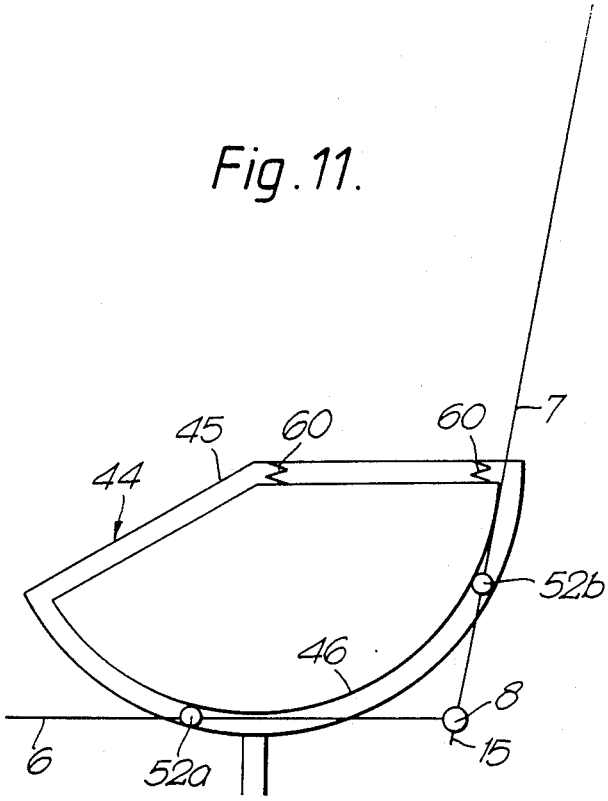
FIGS. 11 and 12 are simplified views on a reduced scale, corresponding to FIG. 8 of the chair of FIGS. 8 to 10 in the locked and released state, respectively.

In the embodiment according to FIGS. 8 to 12, the locking means is the inner part 46, which assumes its locking position in FIGS. 8 and 11. The inner part 46 is likewise preferably of a half-ring shape and constructed in the manner of an angle iron, and is provided with a lateral guiding part 57 and an upper part 58, which has an internal rack 59*a* and 59*b* opposite the internal rack 55*a, b,* and disposed parallel to the latter. The guiding part 57 lies from the outside along an offset recess providing in the guiding part 48 of the outer part 45 and can shift radially relative to the latter.

Figure 12:
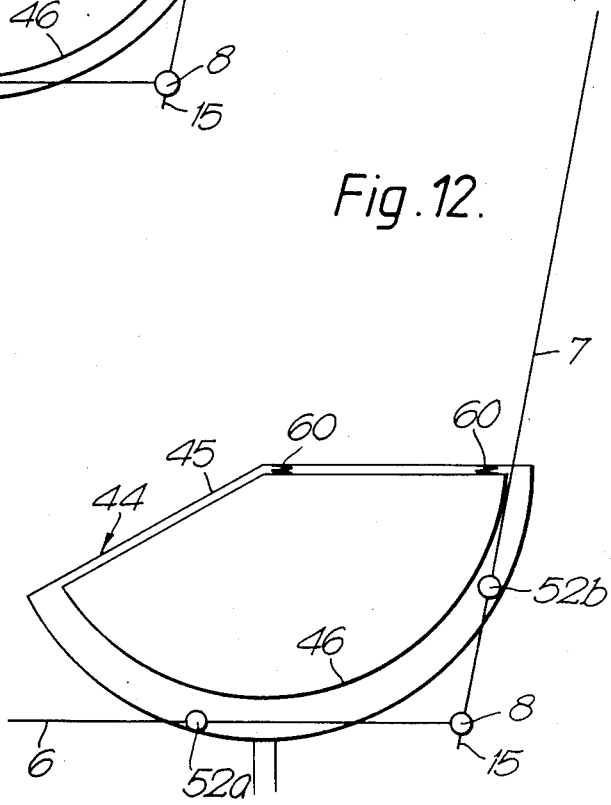
Figure 13:
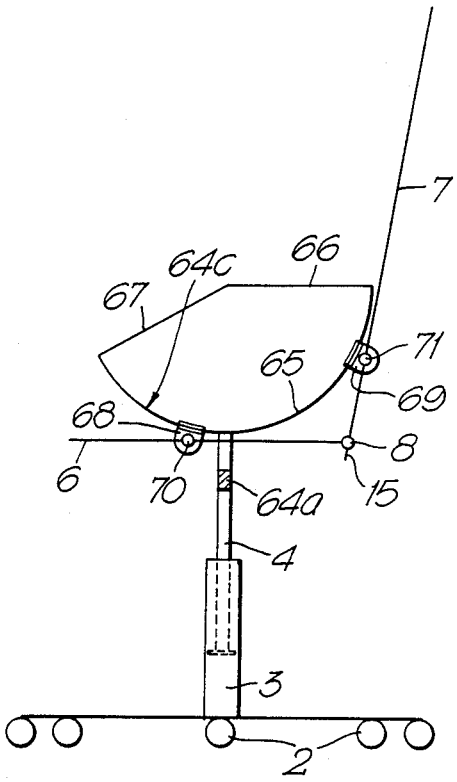
FIGS. 13 to 16 are views corresponding to FIGS. 6, 7, 8 and 10 of a fifth embodiment of the invention.
Figure 14:
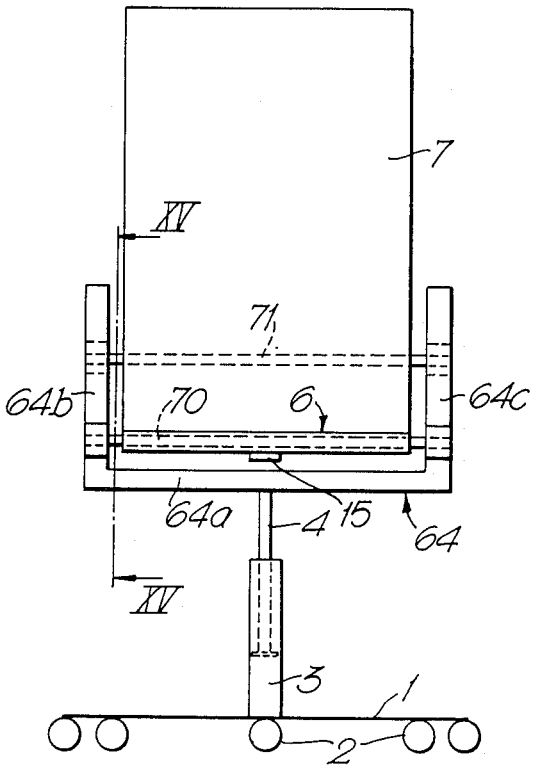
Figure 15:
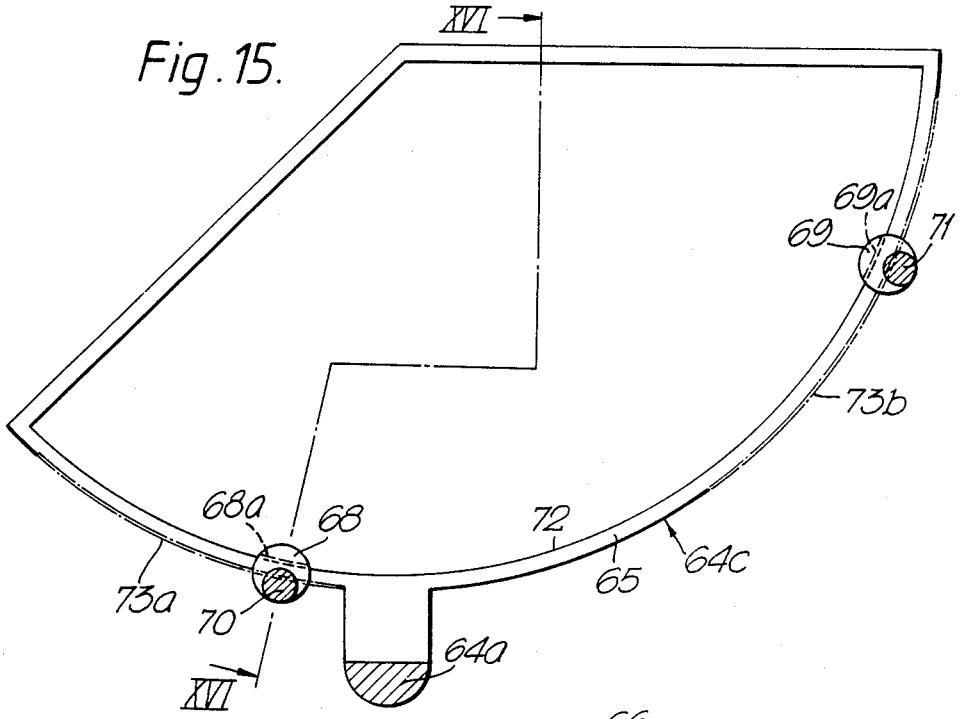

Normally the inner part 46 is biased by means of at least one spring 60 or the like, indicated only diagrammatically in FIGS. 8, 11 or 12, and held between the inner part 46 and the outer part 45, in the locking position that can be seen in FIGS. 8 and 11, in which its internal rack 59*a, b,* is engaged with the gears 52*a, b.* In this locking position it is therefore impossible for the seat or back 6 or 7 to shift in one or the other direction. If, however, the inner part 46 is slightly raised against the force of the spring 60, for which purpose a sufficient free space 61 (FIGS. 8 and 10) is provided between the upper sections of the bottom and top parts 47 and 48 of the inner and outer parts 46 and 45, its internal racks 59*a, b,* will be lifted up from the gears 52*a, b,* as shown in FIG. 12, so that the latter will be able to roll in one or the other direction on the internal racks 55*a, b,* of the outer part 45, so that the position of the seat and/or back 6 and 7 can be changed accordingly. At the same time the spring 60 can be constructed such that it will prevent any lateral pulling of the inner part 46 from the outer part 45.

The internal racks of the inside and outside parts 46 and 45, represented in FIGS. 8 to 12 can extend over the entire length of the bottom or upper parts 47 and 58, or only over sections corresponding to the length of the grooves 49*a, b.* Furthermore, it is possible to dispose the spring 60 or additional springs if desired, between the inner part 46 and the outer part 45 such that the inner part 46 can be moved such that only the gears 52*a* of the seat 6, or the gears 52*b* of the back 7 are released, which permits an independent adjustment of the seat or of the back while the other part is locked up. Finally, it would also be possible to make the inner part 46 bipartite, and to associate the one part with the seat 6, but the other part with the back 7. It would also be possible to omit the inner parts 46 and instead to selectively lock or release the rolling movements of the gears 52*a, b,* with means disposed, for example, in the seat, which are not shown.

The ends of the shafts 53 which are journaled in the seat or back can be replaced by fixed shafts or stubs which are provided with gears mounted rotatably thereon.

The embodiment according to FIGS. 8 to 12 offers the special advantage that the seat 6 or back 7 is positively guided at both lateral ends such that the shafts 53 or the like cannot tilt or bend on account of the teeth at their two ends, as would be conceivable in the case of the positive guidance that is shown by FIGS. 6 and 7.

The spacing of the pins 38*a, b,* and 39*a, b,* and of the gears 52*a, b,* in the embodiments according to FIGS. 6 to 12, from the articulations 8, can be selected as stated for the spacing between the articulations 13 and 14 and the articulations 8 of the embodiment according to FIGS. 1 to 5. The radii of the arcs along which the slots 40, 41, and grooves 49*a, b,* run, can however be made the same as the length of the links 10 and 11 of the embodiment represented in FIGS. 1 to 5.

According a fifth embodiment represented in FIGS. 13 to 18, a U-shaped cradle 64 made preferably in one piece and consisting of a cross member 64*a* and two preferably frame-like side members 64*b, 64c,* disposed perpendicularly thereto, is fastened as in the other embodiments on the shank 4. The side member 64*c* is in a half-ring shape and has a bottom frame part 65, preferably arcuately shaped, which consists, for example, of a structural shape having a rectangular, square, round or tubular cross section and extends, for example, over about one-third of a circle. The one end of the frame part 65 is joined to the one end of a straight piece 66 which is substantially perpendicular to the shank 4 and can also be in the form of an arm rest, while the other end of the frame part 65 is connected by a straight piece 67 to the other end of straight piece 66. The other side part 64*b* is constructed in the same manner. The upper part of side parts 64*b, c,* formed of the straight pieces 66, 67, can alternatively be of a free form or can also be omitted.

The chain constructed according to FIGS. 1 to 5 has on both sides and at points remote from the articulations 8 the bearing elements which consists, for example, of posts 68 provided on both sides of the seat 6 and posts 69 disposed on both sides of the back 7. These posts are affixed to the ends of shafts 70 and 71, respectively, which are journaled in the seat and back 6 and 7, or also they are journaled in shafts fixedly mounted in the seat and back 6 and 7, and have each an opening 68*a* and 69*a,* respectively (FIGS. 17, 18) through which one of the frame parts 65 passes.

The frame parts are provided at their upper parts with cams in the form of slide surfaces 72 and at their bottom parts with racks 73*a, 73b.* The openings 68*a* and 69*a* are defined at their top sides by slide surfaces 74 (FIG. 17) shaped like the slide surfaces 72, and at their bottom sides by sets of teeth 75 shaped like the racks 73*a, 73b,* and their distance from the slide surfaces 74 is slightly greater than the distance between the racks 73*a, b,* and the slide surfaces 72. Between the frame parts 65 and the posts 68, 69, are the springs 76 diagrammatically indicated in FIGS. 16 to 18, and which normally, i.e., when the chair is unoccupied, act upon the posts 68, 69, such that their teeth 75 are in engagement with the racks 73*a, b,* and therefore constitute a locking means which prevents displacement of the posts 68 and 69 on the frame parts 65 (FIG. 17).

If a load is placed on the chair, for example by the action of a person's weight on the posts 68 and/or 69, this will result in a movement of the post 68, 69, transversely of the frame part 65 (FIG. 18). The internal teeth 75 of the post 68, 69, are thus disengaged from the external teeth 73*a, b,* of the corresponding frame part 65, thus producing a release so that the seat and/or back 6 and 7 can not be shifted as desired, by parallel displacement of the slide surfaces 72, 74, along the frame part 65. The frame parts 65 with their slide surfaces 72 thus constitute on the one hand a positive guide for the bearing elements in the form of posts 68, 69, and on the other hand, with their external teeth 75, they form a locking means. An additional locking means which is not shown might be present so as to permit the selected sitting position to be locked even in the loaded state. Preferably the springs 76 and the friction conditions are selected so that, even in the loaded state, an adjustment of the sitting position is possible only with a certain minimum effort and therefore not every slight body movement will result in a change in the sitting position. Furthermore, limiting means not represented are preferably provided which, as in the other embodiments, will limit the possible movement of the posts 68, 69, on the frame parts 65 and will consist, for example, of pins provided on the posts 68, 69, and engaging in grooves in the frame parts 65, or vice versa.

The sixth embodiment of the invention seen in FIGS. 19 to 23 contains, as in FIGS. 1 to 5, the seat and back 6 and 7 joined together by at least one free-floating articulation 8, the links 10 and 11 which are connected by at least one second link 12 to the cradle arms 5*b* and 5*b* not represented, as well as the third and fourth articulations 13 and 14 acting as bearing elements. Other parts identical to the embodiment in FIGS. 1 to 5 have been omitted from FIGS. 19 to 23 for the sake of simplicity.

The sixth embodiment differs from the one according to FIGS. 1 to 5 in that the seat 6 consists of two seat sections 6*a*, 6*b*, hinged to one another by the articulation 14, and the back 7 consists of two back sections 7*a*, 7*b*, hinged together by the articulation 13. The articulation 14 is best situated approximately at the end of the thigh and the articulation 13 about in the area of the lower lumbar vertebra of a person of average size, so that the seat section 6*b* supports the greater part of the thigh and the back section 7*b* the greater part of the back, and parts 6*a* and 7*a* form substantially only a kind of seat bucket.

Figure 19:
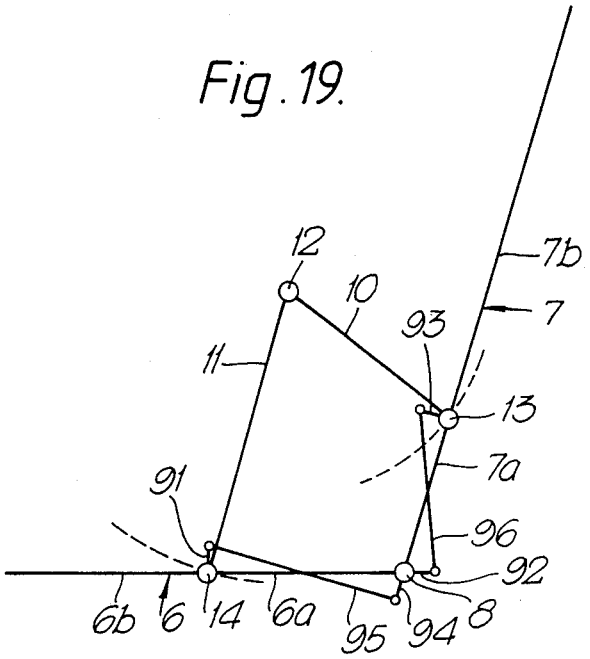
Figure 20:
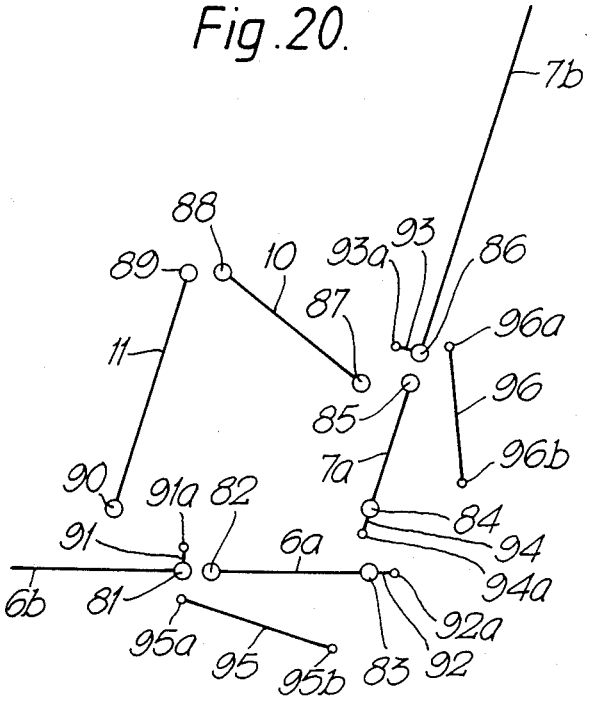

FIG. 20 shows the individual parts diagrammatically before they are assembled. The seat sections and back sections 6*a*, 6*b*, 7*a*, and 7*b* have at their ends and at both sides the hinge eyes 81 to 86, while the links 10 and 11 are provided at their extremities each with hinge eyes 87 to 90. All these hinge eyes are indicated diagrammatically by large circles in FIG. 20, and are joined to one another by hinge pins, through shafts or the like, in the manner seen in FIG. 19, to form the bearings 13, 14. Moreover, the seat section 6*b* has at its end adjacent the seat section 6*a* at least one rigidly attached lever 91 and the seat section 6*a* has rigidly fastened to it a lever 92 prolonged beyond the hinge eyes 83, while accordingly the back section 7*b* is provided on its end adjacent back section 7*a* with at least one rigidly fastened lever 93 and the back section 7*a* is provided with at least one rigidly fastened lever 94 extending beyond the hinge eyes 84. The free ends of the levers 91 to 94 are configured as hinge eyes 91*a* to 94*a*, which are indicated in FIG. 20 by small circles. Lastly, levers 95 and 96 are provided, which are provided at their ends with additional hinge eyes 95*a*, *b*, and 96*a*, *b*, respectively, also indicated by small circles. At the same time, by means of hinge pins, through shafts or the like, the hinge eyes 95*a* are joined to the hinge eyes 91*a*, hinge eyes 95*b* to hinge eyes 94*a*, hinge eyes 96*a* to hinge eyes 93*a* and hinge eyes 96*b* to the hinge eyes 92*a*, to form additional hinges, so that the arrangement shown in FIG. 19 is the result.

By the levers 95, the seat section 6*b* is thus additionally articulated to the lever arm 94 of the back section 7*a*, and the back section 7*b* is articulated to the lever arm 92 of the seat section 6*a*. The result is that, on the one hand, when the link 11 and articulation 14 are held, a movement of the link 10 or of the articulation 13 produces not only the movements of the seat and back sections 6*a*, 7*a*, shown in FIGS. 1 and 2, but additionally the levers 95, 96, perform a turning of the seat sections 6a, 6b, and of back sections 7*a*, 7*b*, relative to one another about the axes of rotation of the articulations 13 and 14. The same applies if the link 10 and the hinge 13 remain fixed in space and only the link 11 or hinge 14 is moved, or both links 10 and 11 and thus also both articulations 13 and 14 are moved relative to one another.

Figure 21:
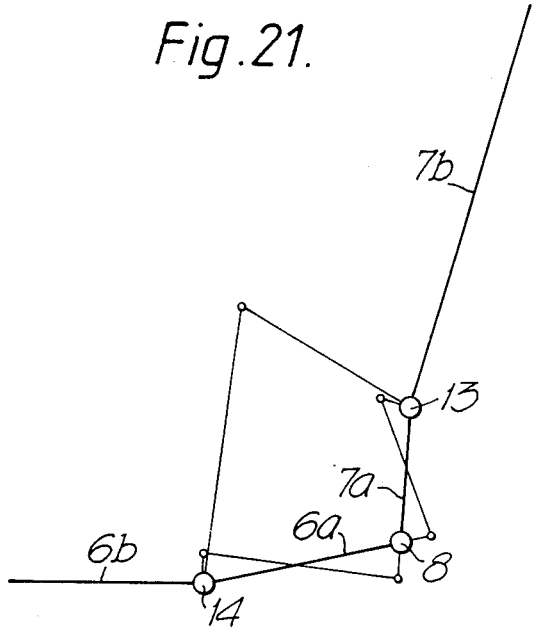

In FIG. 19 is shown a position wherein the seat sections 6*a*, 6*b*, on the one hand, and the back sections 7*a*, 7*b*, on the other, are lying in the same plane in both cases. The lengths of the lever arms 91 to 94 and of levers 95 and 96 are so selected, for example, that, when the angle between the seat section and back section 6*a*, 7*a*, increases, the backs of the back sections 7*a*, 7*b*, form with one another an obtuse angle that gradually becomes greater. If simultaneously the link 11 or articulation 14 is moved in the manner shown in FIGS. 21 to 23, the advantage will be achieved in the recumbent position according to FIG. 3 that the back 7*a*, 7*b*, will lie not in one plane with the seat 6*a*, 6*b*, but the seat and back sections 6*a*, 7*a*, will form a very pronounced bucket seat (FIG. 23) and the back section 7*b* will be substantially parallel to, but slightly higher than, the seat section 6*b*. This permits a comfortable recumbent position from the ergonomic point of view. Furthermore, as FIGS. 21 to 23 show, when the back 7*a*, 7*b*, is lowered, the simultaneous raising up of the seat sections 6*b* intended for the support of the thighs is prevented in a simple manner and without any great shifting of the center of gravity. In an especially preferred embodiment, the seat section 6*b*, in all positions of the chair, is kept in the same, preferably horizontal position (FIGS. 2 to 23) by fixing the articulation 14 rigidly to the support. It is furthermore especially advantageous that the part 7 serving as a back rest is gradually bent backward in the shift from the sitting position to the lying position, especially if the articulation 13 is disposed approximately at the level of the lower lumbar vertebra. A corresponding folding of the part 6 serving as the sitting surface finally produces the result that the anatomically correct bucket seat formed from the sections 6*a*, 7*a*, is preserved or it is formed especially in the transition to the recumbent position. Aside from this, it is possible with such a lever mechanism to establish any other combination of sitting or lying positions considered desirable.

The articulation described in connection with FIGS. 19 to 23 can also be provided in the embodiments according to FIGS. 6 to 18, since it is of no importance to its application how the bearing elements formed by the bearings 13, 14, or the like, are held or supported. Furthermore it is possible to make only the seat or only the back bipartite, and to couple one of the two parts through an articulation to what will then be a one-piece back or seat.

The invention is not limited to the embodiments described, which can be modified in many ways. This is true, for example, of the cradle 5, which could also be fastened on a fixedly mounted frame 1 instead of one that can be moved on wheels or casters 2, but also in regard to the forms described in connection with the drawings, of the supports, frame parts, positive guides, carrying elements, locking devices and the like, which can be adapted especially to the formal requirements of each case, although the embodiment according to FIGS. 13 to 18 is considered as the best solution at the present time, because it requires few parts, is simple in construction, and permits an automatic locking and unlocking of the seat and back merely by body weight displacement, so that no additional control elements have to be provided for this purpose. In particular, it is possible to combine in many ways the individual parts and assemblies which have been described in connection with the six embodiments. It would also be conceivable to mount the various slots, cams or the like, of the positive guiding means on the seat and backs, and the corresponding bolt, journals, gears or the like on the support.

The seat and backs 6 and 7 of the described chair consist, according to FIGS. 1 to 23 of flat components of rectangular or square cross section, which are joined together by the first articulations 8. Alternatively, both parts can also be constructed simply as tubular frames or the like, which serve for the mounting of a full, flexible seat and back unit whose surface is shaped according to the ergonomically desired conditions. Padding or the like has been omitted in the drawing to simplify representation. Since the articulations are free-floating, they can alternatively be replaced by strips or the like, of flexible material.

The radii of the arcs along which the various bearing elements are positively guided can be made of equal size in accordance with FIGS. 6 to 18, or of different sizes as in FIGS. 1 to 5 and 19 to 23. In the case of the embodiments according to FIGS. 6 to 18, this can be accomplished, for example, according to FIG. 24, by providing side parts 101 which have two frame parts 103*a* and 103*b* separated by a step 102, which run along arcs of different radii and serve, for example, for the guidance of the posts 68, 69, according to FIGS. 13 to 18. In like manner, side parts could be provided, constructed in accordance with FIGS. 6 to 12, the slots 40, 41, of which, or inner racks 55*a, b,* run along arcs of different radii. It would furthermore be possible to provide, for example as bearing elements for the back 7, the pivot pins 39*a, b,* according to FIGS. 6 and 7, or the gears 52*b* according to FIGS. 8 to 12, so that their pivot axes will be disposed by their design in the immediate vicinity of the paths of movement established by the positive guiding means, but to make the bearing elements for the seat of the guide bodies 68 according to FIGS. 13 to 18, in whose use the pivot axes (shafts 70) of the seat 6 can be at a relatively great distance from the path (e.g.. slide surface 72) established by the positive guiding means. Such an arrangement is indicated diagrammatically in FIG. 25 in connection with a frame part 105 with which are associated a support element 106 supporting the back, with a pivot axis disposed substantially on the frame axis, and a support element 107 supporting the seat and having a pivot axis 108, which can be at a relatively great distance from the frame part axis. Similar conditions can also be created, for example, by starting out from the embodiment according to FIGS. 6 and 7 and providing cranked or offset journals 38*a, b,* and 39*a, b,* respectively. FIG. 26 shows finally an embodiment in which the paths 111 and 112 established by the positive guide means for bearing elements 109 and 110 are not arcuate but of a different shape. Aside from that it is possible to give the slots 40, 41, according to FIGS. 6 and 7 a different length, for example, or to make the tracks of the positive guide means provided in the other embodiments of different lengths by means of abutments, resulting in different ranges of adjustment for the bearing elements of the seats or backs.

The embodiments according to FIGS. 8 to 16 are furthermore not limited to the described system of teeth 55*a, b,* and 59*a, b,* on the one hand and 73*a, b,* and 75 on the other. These can instead be replaced by cluth surfaces with a sufficiently high friction resistance which are pressed together by the activation of the springs 60 and 76 and then prevent further adjustments of the seat or backs.

In the embodiments according to FIGS. 1 to 5 and 19 to 23 it is not essential that the links 10, 11, be pivoted on the axis represented by the articulation 12. It would also be possible to pivot the links 10 and 11 on different axes. Accordingly, the centers of the paths of movement formed by the cams of the embodiments according to FIGS. 6 to 18, if the paths are circular, can lie on the same axis or on different axes. It is preferred, however, that these two axes be place close together or that they coincide, and that both axes be disposed in the prolongation of the axis 4, because it offers the advantage that the center of gravity of the user's body remains substantially unchanged on the axis 4 or its imaginary prolongation, in all anticipated sitting and recumbent positions, resulting in a high stability of the office chair represented. The same applies during the body weight displacements required for changing the sitting or recumbent position. At the same time it is also advantageous that the back rest be always engaged with the user's back, that each position be able to be locked up, and that the center of gravity of the body be able to shift automatically over the center column (axis 4) of the office chair.

The embodiment described in conjunction with FIGS. 19 to 23 is represented only by a diagram of the articulation, the lengths of the levers 95, 96, and lever arms 91 to 94, and the angles between sections 6*a, 6b,* and 7*a, 7b,* and the lever arms 91 to 94 are represented in simplified form by way of example. Actually there are numerous possible variations of these lengths and angles, and they are carefully coordinated with one another in order to allow for and to follow the natural movements of the human body. Since the levers 95 and 96 are stressed largely by tension it is possible to make them of flexible materials, such as steel cables, instead of stiff materials. Furthermore, it is not necessary to make the pivot axes of the articulations 13 and 14 on the one hand and of the links 81, 82 and 85, 86 on the other hand coaxial with one another. Instead, it would even be conceivable to arrange the bearings 13, 14, separately and at a distance from the bearings 81, 82 and 85, 86, respectively, so that the bearings 13, and 85, 86, on the one hand, and 14 and 81, 82, on the other, will be rotatable about axes disposed at a distance from one another.

The chairs described with the aid of FIGS. 1 to 18 and 24 to 26 and their positive guiding means are designed according to the invention so that they will be able to perform at least the functions now to be described with the aid of FIG. 2. What is essential for this is, on the one hand, the angles of inclination a and b of the seat 6 and back 7, respectively, which are measured from the horizontal when the entire chair is in its position for use on a horizontal, level floor, and on the other hand an opening angle c which is enclosed by the seat and back 6 and 7. The angles of inclination a and b define the absolute position of the seat and back, but opening angle c defines their position relative to one another. In FIG. 2, furthermore, six positions of the chain are represented, which are identified by the lines 121–126.

1. The angle of inclination b of the back can be varied without the need for the angle of inclination a of the seat to be simultaneously varied. This is shown in FIG. 2 in connectionwith the two positions indicated by lines 122 and 124 and which offer different angles b for the back when the seat is horizontal.

2. Likewise, the angle of inclination a of the seat can be changed without the need for simultaneously changing the angle of inclination b of the back. This is not shown separately in FIG. 2, but follows from the analogy of the positive guide means for the seat and back.

3. The opening angle c is automatically varied likewise upon the shifting of the back or seat according to 1 2 above. In addition, it is possible also to change this opening angle c by varying both the angle of inclination a of the seat and the angle of inclination b of the back. This can be seen in FIG. 2, for example, from the position indicated by lines 121, 124 and 125.

4. Lastly, the combination formed of the seat and back can also be inclined as a whole, i.e., with the opening angle c remaining constant, as indicated in FIG. 2, for example, by lines 125 and 126 representing the extreme recumbent position (opening angle $c=180°$. The same can be seen in FIG. 6 in regard to the two sitting positions there represented.

All these various positions can be arrived at continuously, simply by weight displacement, within the boundaries established by the positive guiding means themselves or by the paths prescribed for them and, in some cases determined by the abutments or the like provided at their extremities. Thus, the user of the chair according to the invention will be able to set a great number of sitting and recumbent positions between one extreme sitting position ($c \approx 90°$) and an extreme recumbent position ($c \approx 180°$), and lock them up if necessary by the above-described locking means.

An additional important advantage of the invention is that the center of gravity of the chair based on the center of gravity of the user is always automatically established, essentially over the tube 3 or its shaft 4, regardless of the special sitting or lying position selected. This is especially a consequence of the fact that the positive guide means for the seat 6 are disposed substantially on the one side and the positive guide means for the back 7 are disposed substantially on the other side of a plane running through the shaft 4 and parallel to the axis of rotation of the articulation 8. This is especially the case when the axis of the second articulation 12, or the axes corresponding to this axis, intersect the shaft 4 or are at a short distance from the latter. This assures an extremely great stability of the chair.

It is furthermore especially advantageous that the seat adapts itself automatically to the body weight of the user and no forces are present, such as spring forces or the like, operating against the body weight. Springs or the like would have the disadvantageous result that the user's body would have always to work against a diffuse spring force and the spring force would have to be made adjustable with great complexity of design, so as to be able to adapt it to the weight of the individual user.

For the use of the chair according to the invention it is furthermore advantageous that the contact force of the back of the chair is produced substantially by the user's body weight, since it depends on the distribution of the user's weight in the position assumed in each case. For this reason, no additional forces are necessary, especially no springs or the like, are needed in order to bias the back against the back of the user.

Lastly, in spite of the above-mentioned advantages, the user is held fast and securely in any sitting or recumbent position by the combination of seat and back, since these do not yield elastically, and no forces other than natural gravity occur. Due to the friction present, the chair is otherwise stablized such that, even without locking the seat or back, the current sitting position can be lastingly maintained.

The articulation seen in FIGS. 19 to 23 is designed according to the invention so as to be able to perform at least the functions to be described below in connection with FIGS. 21 to 23. What is important for this purpose is the opening angle d between the two seat sections *6a* and *6b*, the opening angle e between the two seat and back sections *6a* and *7a* connected by the articulation 8, and the opening angle f between the two back sections *7a* and *7b*, these angle being defined in the manner seen in FIG. 22 by the top and front sides of the seat and back sections.

1. In the position visible in FIG. 21, which is assumed to be the extreme sitting position, the rear seat section *6a* is inclined slightly upwardly in comparison with the other seat section *6b*, so that an obtuse opening angle d of somewhat less than 180° results. However, the opening angle e amounts to slightly more than 180°, which corresponds to a comfortable position when sitting upright.

2. In the position shown in FIG. 3, which is assumed to be the extreme recumbent position, the seat and back sections *6b* and *7b* are about parallel, the back section *7b* being in a slightly higher plane, while the seat sections *6a* and *6b* form a reflex opening angle d of slightly more than 180°, and the back sections *7a* and *7b* form a reflex opening angle f which is also greater than 180°, but is definitely smaller than 270°. The seat and back sections *6a* and *7a*, however, as in the extreme sitting position according to FIG. 23, form an obtuse opening angle e which is greater than in FIG. 21, but still considerable smaller than 180°.

3. In the range of transition from the extreme sitting position of FIG. 21 to the extreme recumbent position of FIG. 23, all of the opening angles d, e and f become gradually greater, so that the intermediate position visible, for example, in FIG. 22, can be established. All positions in between can be produced in a continuous manner.

The opening angles independent of one another to be chosen in the various positions depend especially on the purpose for which the chair is used, and are to be so established that all possible sitting and recumbent positions result in a body position that is desirable from the ergonomic viewpoint. The same applies to the relative changing of the opening angles d, e and f with respect to one another in the transition from the position seen in FIG. 21 to the one seen in FIG. 23. It has furthermore proven advantageous to mount the seat section 6b fixedly on the cradle and dispose it substantially horizontally. When installing the chair on the cradle as in FIGS. 1–18 and 24–26, the always horizontal position of the seat section *6b* can be produced on the cradle without fixation by guiding the chair in the positive guiding means, when changing from the extreme sitting position to the extreme recumbent position, such that the angle of inclination of the seat section *6b* does not change from the horizontal.

The same conditions are to be provided for the above-explained angles of inclination and opening angles a to f if the seat and back 6 and 7 or the seat and back sections *6a*, *6b*, *7a* and *7b* do not, as shown, have flat surfaces but ergonomically shaped surfaces or surfaces provided with ergonomical padding.

I claim:

1. Seat units for an office chair or the like, with a seat and back which are adjustable especially by body weight displacement, and having a cradle, in which the seat and the back are hinged to one another by a first freely disposed articulation containing a first axis of rotation, characterized in that the seat (6) and the back (7) are suspended and guided each by means of at least one positive guide on the cradle (5, 34, 64) and are mounted for movement each along a path established by the positive guide, and that the positive guides are so constructed that the opening angle (c) between the seat (6) and the back (7) is variable both by the simultaneous changing of the angle of inclination of the seat and back and by changing the angle of inclination only of the seat (6) or only of the back (7).

2. Seat unit according to claim 1, characterized in that the positive guides are so constructed that the combination of seat and back can be turned as a whole with the opening angle (c) constant.

3. Seat unit according to claim 1, characterized in that the paths established by the positive guides consist of circular paths with centers which lie on the cradle shaft (4) or are disposed at a short distance away from the support shaft (4).

4. Seat unit according to claim 1, characterized in that the positive guides consist of at least two links (10, 11) which are connected each by a second articulation (12) pivotingly with the cradle (5), and the seat and back (6, 7) have at least one bearing element which consists of a third or fourth articulation (13, 14) pivotingly joining the seat or back (6, 7), respectively to one of the links (10, 11).

5. Seat unit according to claim 4, characterized in that the links (10, 11) are each parts of plates (19, 20) lying on a broad surface against one another, and each plate (19, 20) has a slot (21, 22) which runs along an arc through whose center the axis of rotation of the second articulation (12) goes, and that the slot (21, 22) is passed through by a guiding means held on the cradle (5).

6. Seat unit according to claim 4 or 5, characterized in that the second articulation (12) is fixed stationarily on the cradle (5).

7. Seat unit according to claim 1, characterized in that the positive guides consist at least two cams on at least one side member (34*b*, 34*c*; 44, 64*b*, 64*c*) affixed to the cradle (34, 64) and the seat (6) and the back (7) have at least one support element each, which is positively guided on one of the cams.

8. Seat unit according to claim 7, characterized in that, on the cradle (34) and on both sides of the seat and back (6, 7) there is fastened one side member (44) each with at least one cam configured as an internal rack (55*a*, 55*b*) and the bearing elements consists of gears (52*a*, 52*b*) provided on the seat and back (6, 7) and guided on the internal rack (55*a*, 55*b*).

9. Seat unit according to claim 8, characterized in that the side members (44) consist each of an outside part (45) having the internal teeth (55*a*, 55*b*) and an inside part (46) configured as a locking means for the bearing elements, and the inside parts (46) have internal teeth (59*a*, 59*b*) which can be brought into engagement with the gears (52*a*, 52*b*).

10. Seat unit according to claim 9, characterized in that the inside parts (46) are biased by spring force to a locking position in which the internal teeth (59*a*, *b*) are in engagement with the gears (52*a* , 52*b*).

11. Seat unit according to claim 7, characterized in that on the cradle (64) and on both sides of the seat or back (6, 7) a side member (64*b*, 64*c*) is fastened which has at least one cam configured as a frame part (65), and the bearing elements consist of posts (68, 69) displaceably mounted on the frame parts (65), which are provided with passages (68*a*, 68*b*) through which the frame parts (65) pass, which are defined on at least one side by slide surfaces (74) cooperating with the frame parts (65).

12. Seat unit according to claim 11, characterized in that external teeth (73*a*, 73*b*) provided on the bottoms of the frame parts (65), and internal teeth (75) which can be brought into engagement with the latter, form a locking means for the bearing elements on walls of the posts (68, 69) associated with them and defining the passages (68*a*, 68*b*).

13. Seat unit according to claim 12, characterized in that the external and internal teeth (73*a*, *b*; 75) are held in engagement by spring force when the seat and back (6, 7) are not under load, and can be brought out of engagement by loading the seat and back (6, 7).

14. Seat unit according to claim 1, characterized in that the seat (6) consists of two seat sections (6*a*, 6*b*) joined pivotingly to one another and the back (7) consists of two back sections pivotingly joined to one another, the one seat section (6*a*) being joined pivotingly by the articulation (8) to the one back section (7*a*) and additionally the seat sections (6*a*, 6*b*) and the back sections (7*a*, 7*b*) are articulately joined to one another by an articulation (91–96) such that, in the transition from an extreme sitting position to an extreme recumbent position, the opening angle (d, e, f) between the two seat sections (6*a*, 6*b*) and between the two back sections 7*a*, 7*b*) gradually becomes greater in a manner determined by the articulation.

* * * * *